US005170508A

United States Patent [19]

Kawada

[11] Patent Number: 5,170,508

[45] Date of Patent: Dec. 15, 1992

[54] GOLF GLOVE

[75] Inventor: Toshiyuki Kawada, Kagawa, Japan

[73] Assignee: Kawada Industrial, Inc., Okawa, Japan

[21] Appl. No.: 649,460

[22] Filed: Feb. 5, 1991

[30] Foreign Application Priority Data

Feb. 6, 1990 [JP] Japan ..... 2-11279[U]

[51] Int. Cl.[5] ..... A41D 19/00

[52] U.S. Cl. ..... 2/161 A; 2/162

[58] Field of Search ..... 2/161 A, 162, 16, 159, 2/161 R, 169, 158; 273/183 B, 188 R, 35 R

[56] References Cited

U.S. PATENT DOCUMENTS

| | | | |
|---|---|---|---|
| 2,154,974 | 4/1939 | Callaway | 2/161 A |
| 2,831,196 | 4/1958 | Scheiber | 2/161 A |
| 3,228,035 | 1/1966 | Davis | 2/161 A |
| 4,057,255 | 11/1977 | Bishop | 2/161 A X |
| 4,502,688 | 3/1985 | Papp | 2/161 A X |
| 4,658,445 | 4/1987 | Tribble | 2/161 A |
| 4,958,384 | 9/1990 | McCrane | 2/161 A X |

*Primary Examiner*—Werner H. Schroeder
*Assistant Examiner*—Sara M. Current
*Attorney, Agent, or Firm*—Wenderoth, Lind & Ponack

[57] ABSTRACT

A golf glove has a glove body including a back member and a palm member, and a binding band. The binding band has a wide base portion for preventing the back of the hand inserted in the glove from bending backward, an intermediate portion for preventing the thumb from bending backward contiguous with the base portion, and a narrow end portion continuous with intermediate portion for preventing the thumb from bending. A pair of detachable surface fasteners are secured to the back of the base portion and to the back member. Another pair of detachable surface fasteners are secured to the back of the end portion and to the palm member.

2 Claims, 2 Drawing Sheets

GOLF GLOVE

BACKGROUND OF THE INVENTION

The present invention relates to a golf glove.

In order to drive a golf ball straight ahead, it is essential to prevent the left hand (right hand in the case of a left-hander) from bending backward from the wrist during one's swing. For this purpose, a known golf glove has a hard and wide plate member attached to the back thereof.

But with this golf glove, since the plate member is fixed to the back of the glove, it is impossible to adjust the extent to which the bending of the wrist is prevented. Further, this type of golf glove cannot prevent the thumb from bending backward.

SUMMARY OF THE INVENTION

An object of the present invention is to provide a golf glove capable of preventing both the hand and its thumb from bending backward.

According to the present invention, a binding band is attached to the back member of the golf glove. The binding band comprises a wide base portion for preventing the back of the hand from bending, an intermediate portion contiguous with the base portion for preventing the thumb from bending, and a narrow end portion. A pair of surface fasteners are secured to the back of the base portion and to the back member. Also, a pair of surface fasteners are secured to the back of the end portion and to the palm member of the glove.

Thus, according to the present invention, when a golf club is gripped and swung, the lower edge of the base portion abuts the wrist, thus preventing excessive bending of the hand. Also the intermediate portion serves to prevent the thumb from bending excessively.

BRIEF DESCRIPTION OF THE DRAWING

Other features and objects of the present invention will become apparent from the following description taken with reference to the accompanying drawings, in which.

DETAILED DESCRIPTION OF THE PREFERRED EMBODIMENT

Figure 1:
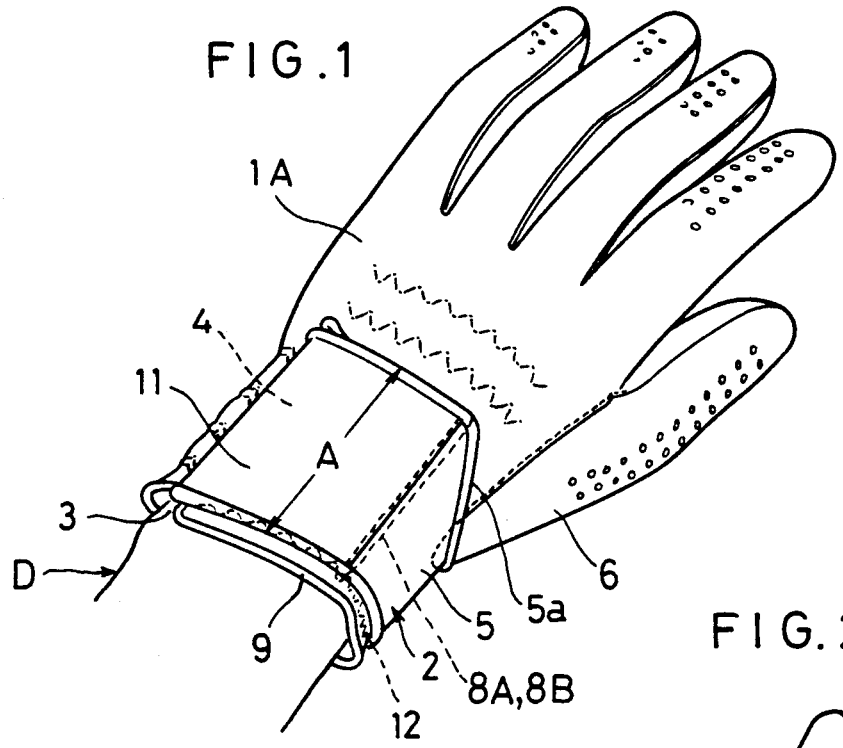
FIG. 1 is a perspective view of the golf glove according to the present invention as seen from the back side thereof.
Figure 2:
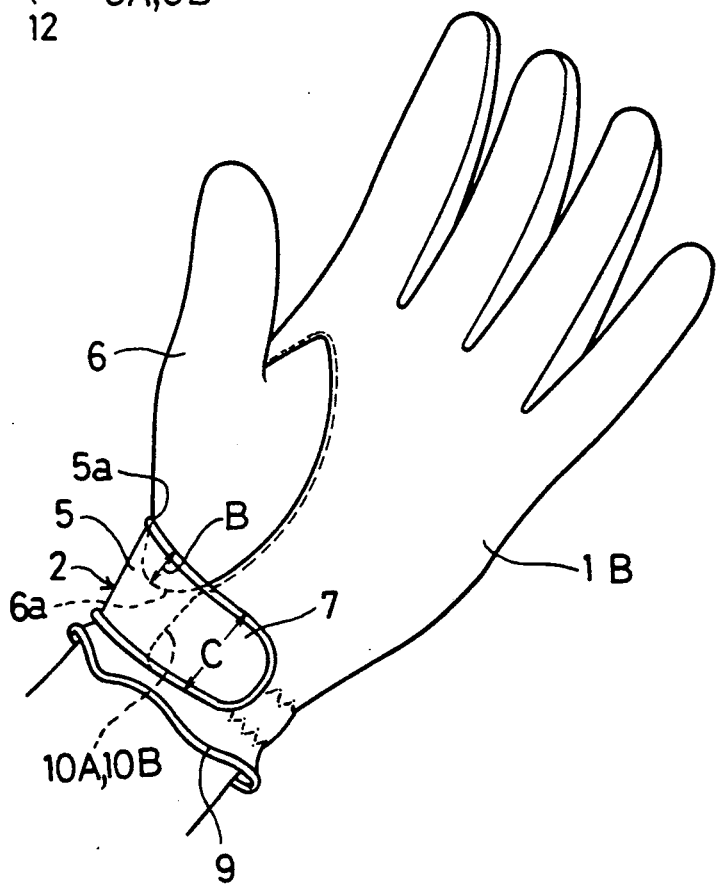
FIG. 2 is a perspective view of the same as seen from the palm side thereof.
Figure 3:
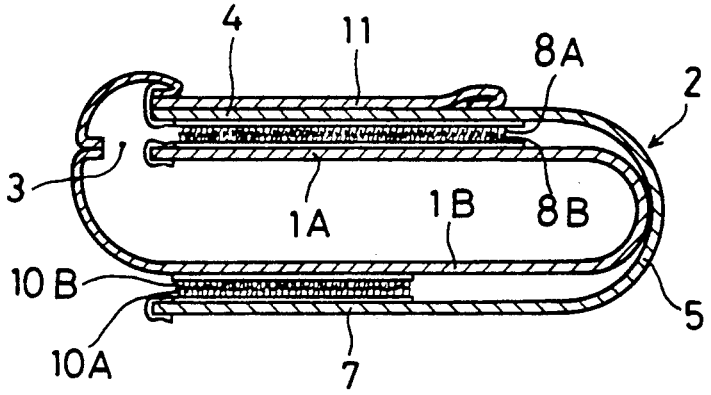
FIG. 3 is a sectional view of the base portion 4 for preventing the hand from bending backward.

The golf glove according to the present invention has a wide binding band 2 made of cow skin and extending to the intermediate portion of a back member 1A of sheep skin. It has part of its rear edge connected to the edge 9 of the glove defining a lefthand opening 3 in the back member 1A. The binding member 2 comprises a base portion 4 for preventing the hand from bending backward (5–8 cm in width A), an intermediate portion 5 contiguous with the base portion 4 and having an obliquely extending front edge 5*a* for preventing the thumb from bending back (a portion of edge 5*a* overlapping a bottom edge 6*a* of a thumb member 6 over a width B of 0.5–1 cm), and an end portion 7 (2–3 cm in width C).

A pair of surface fasteners 8A and 8B of a touch close type are stitched to the back of the base portion 4 and to the front lower part of the back member 1A, respectively. Also, a pair of surface fasteners 10A and 10B of the same type are stitched to the back of the end portion 7 and to the lower portion of the back member 1A at the center of the palm side, thereof, respectively. A reinforcing member 11 made of sheep skin is stuck on the base portion 4 to increase its strength.

Numeral 12 designates a stitching securing the lower edge of a rubber band 13 around the edge 9 defining the opening, of the glove. Reference 1B designates is a palm member.

In use, the left hand of a player is inserted into the glove through the opening 3 defined by the edge 9. The binding member 2 comprising the portions 4 and 5 for preventing the hand and the thumb from bending, respectively, and the end portion 7 are secured by pressing the surface fasteners 8A and 8B and 10A and 10B against each other.

Figure 4:
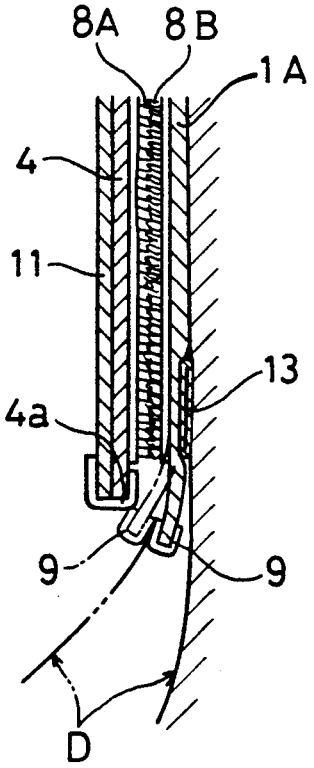
FIG. 4 is a sectional view of the base portion showing the operation of the glove.

When a golf club is gripped and swung in this state, even if the back and thumb of the left hand undergo such a force as to bend them as shown by chain lines in FIG. 4, the portion 4, the surface fasteners 8A and 8B and the back member 1A, i.e. the lower edge 4*a* of the base portion 4 will abut the wrist D at the edge 9. Thus the portions 4 and 5 serve to prevent excessive bending of the hand and thumb, respectively.

If it is desired to restrict the bending of the hand more strictly, the binding band 2 is detached and fastened again so that the surface fastener 8A on the portion 4 will be vertically offset from the surface fastener 8B on the back member (so that the width A of the base portion 4 will effectively increase). In order to restrict the bending of thumb more strictly, the binding band 2 is adjusted so that the upper edge 5*a* of the portion 5 will be located in a higher position.

The present invention is not limited to the above embodiment, but various modifications and alterations can be made on the above embodiment within the scope of the present invention.

For example, the reinforcing member 11 can be omitted and instead, the hardness of the portion 4 and of the surface fastener 8A can be relatively great.

What is claimed is:

1. A golf glove comprising: a glove body having a back member and a palm member, and a binding band secured to said glove body at one end of the band, said binding band comprising a base portion for preventing a hand inserted in said glove from bending backward, an intermediate portion contiguous with said base portion for preventing the thumb from bending backward, a narrow end portion at the other end of the band and contiguous with said intermediate portion, a pair of surface fasteners secured to the back of said base portion and to said back member, respectively, and another pair of surface fasteners secured to the back of said end portion and to said palm member, respectively.

2. A golf glove comprising: a glove body including a back portion to be worn over the back of a user's hand, a palm portion to be worn over the palm of the user's hand, and a thumb portion to receive the thumb of the user's hand, and a binding band having a first end secured to said glove body, a base portion including a reinforcing member positionable over the back portion of said glove body, an intermediate portion contiguous with said base portion, part of said intermediate portion being positionable over part of the thumb portion of said glove body, and an end portion contiguous with said intermediate portion, the end portion defining a free end of said band opposite the first end thereof and having a width that is narrower than the width of said base portion, a pair of fasteners detachably securable to one another and fixed to the back of said base portion and to said back member, respectively, and another pair of fasteners detachably securable to one another and fixed to the back of said end portion and to said palm member, respectively, said binding band being securable against said glove body when said fasteners are respectively secured to one another in a position in which the base portion thereof overlies the back portion of the glove body so as to inhibit a user's hand inserted in the glove from bending backward and part of the intermediate portion thereof overlies part of said thumb portion of the glove body so as to inhibit the user's thumb from bending backward.

* * * * *